United States Patent [19]

Gagné

[11] 4,041,197

[45] Aug. 9, 1977

[54] METHOD FOR COATING A SUBSTRATE WITH PLASTIC

[76] Inventor: Rudy L. Gagné, 998 Ingram Crescent, Midland, Ontario, Canada

[21] Appl. No.: 645,170

[22] Filed: Dec. 29, 1975

[30] Foreign Application Priority Data

Nov. 7, 1975 Canada ..... 239380

[51] Int. Cl.[2] ..... B05D 3/12; B05D 1/28

[52] U.S. Cl. ..... 427/278; 427/359; 427/361; 427/362; 427/366; 427/428; 118/44; 118/60; 118/212; 118/235

[58] Field of Search ..... 118/44, 60, 212, 235; 427/278, 359, 361, 362, 366, 428

[56] References Cited

U.S. PATENT DOCUMENTS

| | | | |
|---|---|---|---|
| 3,196,030 | 7/1965 | Petry | 427/278 X |
| 3,278,322 | 10/1966 | Harkins et al. | 427/278 |
| 3,338,731 | 8/1967 | Sommer | 427/278 X |
| 3,349,749 | 10/1967 | Utschig | 118/60 |
| 3,392,701 | 7/1968 | Long | 118/212 |
| 3,788,872 | 1/1974 | Sigman | 427/278 |
| 3,959,546 | 5/1976 | Hill | 427/362 X |

FOREIGN PATENT DOCUMENTS

| | | | |
|---|---|---|---|
| 1,205,964 | 9/1970 | United Kingdom | 427/278 |

*Primary Examiner*—Michael R. Lusignan
*Attorney, Agent, or Firm*—Rogers, Bereskin & Parr

[57] ABSTRACT

A method is disclosed for coating a substrate or web with a plastic material. A liquid plastisol coating is applied to the web and the coated web is then passed between a put-on roll and a heat drum, which heats and cures the plastisol. The put-on roll is pressed against the heat drum to compress the coated web. The plastisol is partially cured to gelation while being compressed by the put-on roll, and the curing of the plastisol is completed during further travel of the web around the heat drum.

14 Claims, 1 Drawing Figure

METHOD FOR COATING A SUBSTRATE WITH PLASTIC

Figure 1:
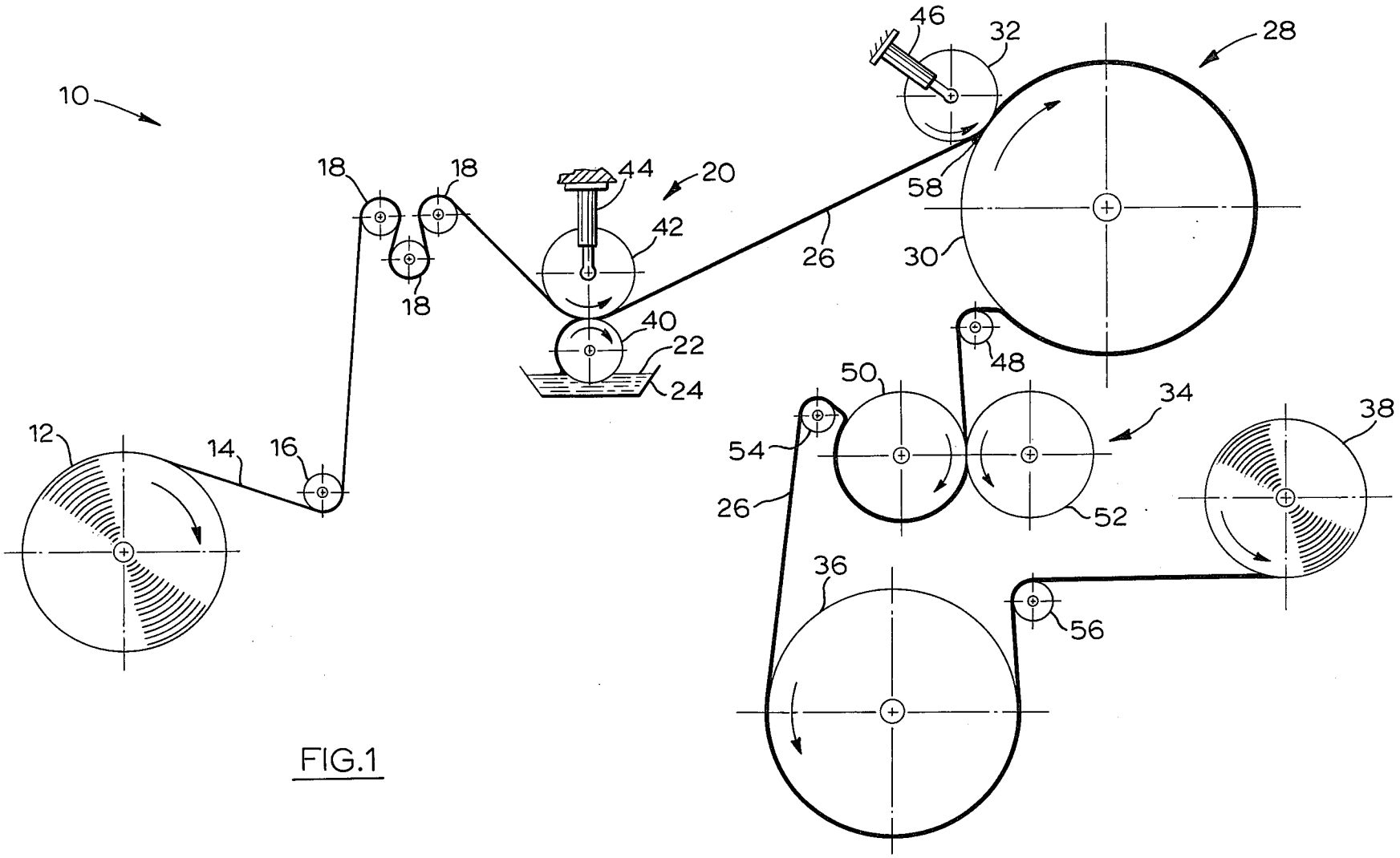

This invention relates to a method for coating a web or substrate with a plastic material. In particular, the invention relates to the production of vinyl coated substrates by coating the substrate with plastisol and then curing the plastisol by the application of heat.

Plastic coated substrates have been produced in the past for a wide variety of uses, such as wall coverings, floor coverings, upholstery materials and wearing apparel fabrics. One method that has been commonly used in the past for producing these products is to laminate a plastic sheet and a sheet of substrate, such as paper or fabric. A difficulty with this method is that adhesion of the plastic laminate to the substrate is not always satisfactory. Further, a large inventory of plastic laminates is usually required, and this inventory is prone to damage and waste through mishandling.

Another method of producing plastic coated substrates which has been used in the past and which overcomes some of the difficulties of the laminating method, is to coat the substrate with a liquid plastic, such as a plastisol or an organosol, and then cure or harden the liquid plastisol by the application of heat. In the past, this heat has been applied by passing the coated substrate through curing ovens. A problem with this oven curing method is high energy consumption. Also, oven curing generally causes excessive fumes or smoke to be emitted from the plastic, necessitating the use of extensive pollution control equipment. Further, oven curing coating machines tend to be very expensive to manufacture and operate.

In the present invention, a substrate is coated with liquid plastic and this plastic is cured by the direct application of pressure and heat. The apparatus is simple and relatively inexpensive to manufacture and operate.

According to one aspect of the invention, there is provided a method of producing a plastic coated substrate which includes coating the substrate with a liquid plastic. The coated substrate is then compressed and heated to cure the liquid plastic.

According to another aspect of the invention, there is provided a method of plastic coating a web which includes coating the web with a layer of plastisol. Pressure and heat is then applied to the web to compress the coated web and partially cure the plastisol, and then additional heat is applied to the coated web until complete fusion occurs in the plastisol.

According to yet another aspect of the invention, there is provided a method of producing a plastic coated substrate which includes coating the substrate with a plastisol. The coated substrate is compressed and a shear stress is applied to the plastisol to spread the plastisol to form a continuous coating while compressing the coated substrate. Also, the coated substrate is heated to cure the plastisol.

A preferred embodiment of the invention will now be described, by way of example with reference to the accompanying drawing, in which FIG. 1 is a schematic representation of a machine according to the present invention for the plastic coating of a web or substrate.

Referring to FIG. 1, coating apparatus for producing plastic coated substrates according to the method of the present invention is generally indicated by reference numeral 10. A roll of substrate 12 is unwound in a conventional manner to provide a web 14 which passes around a guide roll 16 and through a plurality of pull rolls 18 to a coating station generally indicated by reference numeral 20. The coating station 20 applies a layer or coating of liquid plastic or plastisol to web 14 from a supply of plastisol 22 located in a trough or pan 24. A coated substrate 26 leaves coating station 20 and enters a curing station 28 which includes a heat drum 30 and a put-on roll 32. Heat drum 30 and put-on roll 32 compress and heat the coated substrate 26 to cure the plastisol resulting in the plastic coated substrate desired.

Further stages of coating apparatus 10 include an embossing station 34 and a cooling roll 36. The plastic coated substrate leaves cooling roll 36 and is wound into a finished roll 38, or the substrate may undergo further processing such as trimming and printing before being wound into finished roll 38.

In the following description of the preferred embodiment, the term substrate and web will be used interchangeably to refer to the material which is to be coated with liquid plastic. Typical substrates are: various types of paper, cotton scrim and nylon scrim, either of the woven or non-woven type. Almost any type of substrate could be used provided the plastisol being used will adhere to the substrate, and the substrate will withstand being heated to a temperature high enough to cure the plastisol (typically 175° Centigrade).

The liquid plastic used to coat the substrate in the prefered embodiment is a plastisol which has a vinyl chloride type resin suspended in a liquid plasticizer. A polyvinyl chloride homopolymer resin has been found to give particularly good results. The nature of this plastisol will be described further below, however, it will be appreciated that other types of liquid plastics may be used to coat the substrate, provided these coating materials have the properties described below.

Coating apparatus 10 according to the preferred embodiment of the invention will now be described in detail. The substrate roll 12 used with coating apparatus 10 is a roll of paper such as is used for the manufacture of printed wall coverings or wallpaper. A typical example of this paper is a 55 pound high groundwood type paper referred to by those skilled in the art as Number 2 hanging wallpaper stock. Rolls of this paper are typically about 50 to 76 centimeters in width, and therefore coating apparatus 10 is of a corresponding width.

Substrate roll 12 is supported in an unwind stand (not shown), which may be of the single position type or the dual position type (for continuous operation). The substrate is unwound and passed under guide roll 16 and up through pull rolls 18, which are a form of constant web tension device. The unwind stand and pull rolls 18 are conventional apparatus and will not be described in further detail. However, it will be appreciated that there are many different types of unwind apparatus and tensioning devices available which may be used with coating apparatus 10 to provide a uniformly tensioned web of substrate entering coating station 20.

Coating station 20 is a conventional type coater commonly referred to as a direct gravure coater. This coater has a bottom applicator roll 40 which is either a pin roll or a chrome-plated steel tubular roll which is engraved in an overall knurl type pattern. This applicator roll 40 is partially emersed in plastisol supply 22, so that it picks up the plastisol when rotated. Applicator roll 40 is typically about 15 centimeters in diameter. A rubber or elastomer coated back-up roll is located above applicator roll 40 in the gravure coater. Also, actuators 44 (one at each end of back-up roll 42) are used to provide vertical movement and press back-up roll 42 against applicator roll 40. Substrate 14 passes between applicator roll 40 and back-up roll 42 where plastisol is transferred from the applicator roll to the web to produce coated substrate 26. The coating thickness and uniformity is dependant upon the nature of the surface of applicator roll 40, and also on the pressure of back-up roll 42 against applicator roll 40 (referred to as the coater nip pressure). A typical coater nip pressure is 3.16 kilograms per square centimeter.

Coated substrate 26 leaves coating station 20 and then enters curing station 28 between heat drum 30 and put-on roll 32. Heat drum 30 is a conventional type steam heated steel drum having a highly polished chrome-plated surface. Heat drum 30 is typically about one meter in diameter and is steam heated in a conventional manner using saturated steam. The temperature of heat drum 30 depends upon the curing temperature of the particular plastisol 22 being used, but typically the temperature of heat drum 30 is between 150° Centigrade and 180° Centigrade and the pressure of saturated steam being supplied to drum 30 is between 4.76 kilograms per square centimeter and 9.52 kilograms per square centimeter.

Put-on roll 32 is an elastomer or a rubber covered roll approximately 20 centimeters in diameter. Put-on roll 32 is moved radially toward and away from heat drum 30 by actuators 46 (one actuator on each end of put-on roll 32), which also press put-on roll 32 against heat drum 30. The pressure of put-on roll 32 against heat drum 30 (referred to as the put-on roll nip pressure) is typically about 1.4 kilograms per square centimeter.

Coated substrate 26 travels around heat drum 30 and is removed therefrom (after the plastisol has been heated and cured or hardened) by a stripper roll 48, which is approximately 8 centimeters in diameter. Stripper roll 48 is a steel roll which is highly polished, or coated with an anti-friction coating. Stripper roll 48 is also heated by saturated steam, at a typical pressure of 3.5 kilograms per square centimeter, in order to keep coated substrate 26 hot as it leaves heat drum 30 and enters embossing station 34.

Embossing station 34 includes a conventional engraved steel embossing roll 50 and an elastomer covered bed roll 52. Embossing roll 50 and bed roll 52 are water cooled to maintain operating temperatures between 150° Centigrade and 180° Centigrade. A second stripper roll 54, which is similar to stripper roll 48, is used to remove the embossed coated substrate 26 from embossing roll 50.

Coated substrate 26 leaves embossing station 34 and travels around cooling roll 36 to be cooled approximately to room temperature. Plastisols and organosols are thermoplastic and therefore need to be cooled before being wound up or subjected to compression forces. Cooling roll 36 is a conventional water cooled steel roll. The substrate leaves cooling roll 36 and passes over a second guide roll 56 and is then wound into finished roll 38 using any conventional winding equipment.

In the operation of coating apparatus 10, the substrate or web to be coated is unwound and fed to coating station 20 under controlled tension. The tension applied to the web depends on the particular substrate being coated, but in general, the tension is kept high enough to avoid the formation of wrinkles and low enough to avoid breakage of the web. Coating station 20 coats the web with a layer of plastisol. The thickness of this plastisol layer depends upon nip pressure between the applicator roll 40 and back-up roll 42 and on the viscosity of the plastisol. However, the thickness of the coating is normally up to approximately 0.25 millimeters, with a 0.13 millimeter thick coating being typical.

As the coated substrate 26 enters curing station 28 between put-on roll 32 and heat drum 30, the plastisol begins to be worked and cured by the application of pressure and heat. A bank of plastisol 58 is formed between the web and heat drum 30 as the coated web enters the nip of the put-on roll and heat drum. This plastisol bank 58 is a result of a squeezing action caused by the pressure of the put-on roll 32 against heat drum 30. This squeezing action promotes adhesion of the plastisol to the web and also produces a shear stress in the plastisol which smooths the plastisol coating prior to being compressed by put-on roll 32 and heat drum 30. As a result of this smoothing acton, the plastisol coating being applied to the substrate by applicator roll 40 does not have to be particularly uniform or even. The plastisol undergoes a shear stress and is smoothed as long as plastisol bank 58 is formed, and vice versa. The size of the plastisol bank 58 that is formed during the operation of coating apparatus 10 is directly related to the thickness of the plastic coating on the finished coated substrate, as will be discussed further below.

As the substrate coated with liquid plastisol enters the nip between put-on roll 32 and heat drum 30, in addition to being smoothed and compressed, the plastisol is partially cured by the application of heat from drum 30. This partial cure is referred to by those skilled in the art as gelation, and typically occurs when the plastisol reaches approximately 80° Centigrade. As a result of this gelation, as the coated plastisol leaves the nip of put-on roll 32, the plastisol has lost its fluidity and has become a dry mass, although the partially cured plastisol lacks cohesive strength at this point. As the coated plastisol proceeds further around heat drum 30, the temperature of the coated substrate rises and the curing of the plastisol is completed. This latter stage of curing is referred to by those skilled in the art as fusion, and is typically completed when the plastisol reaches a temperature of about 165° Centigrade.

After the coated substrate has been cured, it is removed from heat drum 30 by being passed over stripper roll 48. This stripper roll is heated during the operation of coating apparatus 10 to help prevent the coated substrate 26 from being cooled too much prior to entering embossing station 34. The temperature of the coated substrate should be approximately between 150° Centigrade and 180° Centigrade as the substrate enters embossing station 34, and therefore stripper roll 48 is heated to maintain the substrate temperature between this range. However, stripper roll 48 is usually not heated until after apparatus 10 has been started up and is running, to avoid possible burns while threading the web at start-up.

The operation of embossing station 34 is conventional and will not be described in detail. However, it will be appreciated that the substrate may be embossed to produce any pattern or finish, including no embossing at all, if this is desired. After leaving embossing station 34, the coated substrate is cooled by cooling roll 36 for the reasons discussed above, and also to facilitate handling of finished roll 38.

The thickness of the plastic coating on the finished coated substrate depends primarily on the amount of plastisol that is applied to the substrate in coating station 20. To increase the coating thickness, the nip pressure between applicator roll 40 and back-up roll 42 is reduced. Conversely, to decrease the thickness of the plastisol coating, the nip pressure associated with applicator roll 40 is increased. In other words, for heavier plastisol coatings the nip of the coater rolls is opened to allow more plastisol to be applied per unit surface area of the substrate. The amount of plastisol being applied to the substrate is directly related to the size of plastisol bank 58 preceeding the nip of put-on roll 32. This provides a visual check on the uniformity of the coating thickness. Further, as long as plastisol bank 58 exists, an operator of coating apparatus 10 will know that a shear stress is being applied to the plastisol by put-on roll 32 to smooth the plastisol and make the coating uniform in thickness across the width of the machine. If plastisol bank 58 disappears during the operation of apparatus 10, the operator will know that the coater nip pressure should be decreased (to apply more plastisol), or some other adjustment should be made to the coating apparatus, unless it is desired not to have plastisol bank 58 formed, as discussed below.

The thickness or uniformity of the plastisol coating also depends to a lesser extent on the nip pressure between put-on roll 32 and heat drum 30, and the speed of the substrate through coating apparatus 10. The nip pressure associated with put-on roll 32 is generally held constant for any particular substrate or type of plastic coating being applied to the substrate. The speed of the substrate through apparatus 10 is also generally held constant, again depending upon the substrate being coated and the characteristics of the coating being applied to the substrate. Of course, the speed of the substrate through apparatus 10 will determine the curing time, or the time during which the coated substrate is in contact with heat drum 30. In general, if the speed of travel of the substrate through apparatus 10 is increased, the temperature of heat drum 30 must also be increased to ensure that the plastisol coating reaches a high enough temperature to obtain complete fusion or curing. A typical speed range of the web through coating apparatus 10 is from 15 meters per minute to 300 meters per minute.

As mentioned above, the thickness of the plastic coating and the speed of travel of substrate 26 through the apparatus depends in part upon the characteristics of the plastisol or other plastic material being used to coat the particular substrate being coated. However, certain guidelines may be established for the operation of apparatus 10 depending upon the characteristics of the finished product being produced. In general, if heat drum 30 is too hot, the plastisol may pick off the substrate and plate out onto the surface of the heat drum, or the plastisol may blister, especially along the edges of the substrate. If this happens, the temperature of the heat drum may be reduced or the speed of the substrate through apparatus 10 may be increased, or both. If heat drum 30 is too cold, the plastisol may not fuse completely and some plastisol may also plate out and remain on the heat drum. The plastisol will appear gummy on the heat drum and may not adhere to the web. If this happens, the temperature of the heat drum may be increased or the speed of the web travelling through the apparatus may be reduced. Plastisol may be removed from the heat drum surface if necessary, by cleaning the hot drum with stearic acid.

To summarize the adjustments that may be made to apparatus 10, thinner coatings generally require higher nip pressure at the applicator and put-on rolls. Thicker coatings generally require a reduction in nip pressure at the applicator roll. Higher web speeds usually involve higher heat drum temperatures, but these parameters may be adjusted relative to each other as indicated above if the plastic coating is not being cured properly or is not adhering properly to the web. The particular values of speed, temperature and nip pressures will depend upon the characteristics of the plastisol being used and will be discussed further below, but the values mentioned above are typical and may be adjusted fairly simply to produce a satisfactory end product.

Having described a preferred embodiment of the apparatus and method of the present invention, it is helpful to consider the nature of the plastic coating materials that could be used with the present invention and the preferred plastisol material of the present invention. The liquid plastic materials with which the present invention is primarily concerned are commonly referred to as plastisols and organosols. A plastisol is a dispersion of finally divided resin in a plasticizer to produce a fluid mixture which may range in viscosity from a pourable liquid to a heavy paste. An organosol is a plastisol in which a solvent has been added (usually in excess of 10% of the total content) in order to reduce the viscosity of the fluid. The addition of heat to the plastisol or organosol causes the plasticizer to solvate the resin (or the resin to dissolve into the plasticizer), until the mixture gels and undergoes fusion to produce a cured plastic material. In the case of an organosol, the volatile solvents are driven off or evaporated prior to fusion.

The present invention is concerned primarily with plastisols, and in particular with plastisols in which the resin ingredient is polyvinyl chloride, or a vinyl chloride copolymer, e.g. a vinyl chloride-vinyl acetate copolymer. The use of organosols is generally not preferred because the evaporation of solvents which occurs during curing generally requires the use of expensive pollution control devices in connection with coating apparatus 10. The major components of a typical plastisol which may be used in association with coating apparatus 10 is as follows:

| Ingredient | Normal Range | Typical Value |
|---|---|---|
| Dispersion resin | 60 to 100 parts | 90 parts |
| Extender resin | 0 to 40 " | 10 " |
| Plasticizer | 30 to 100 " | 50 " |
| Stabilizer | 1 to 5 " | 3 " |
| Filler | 0 to 50 " | 10 " |
| Pigment | 0 to 5 " | 1 " |
| Volatile diluent | 0 to 10 " | 3 " |
| Miscellaneous additives | 0 to 5 " | 0.5 " |

Each of the above components will now be described briefly in order to further indicate the expected performance characteristics of typical plastisol coatings in the present invention.

The effect of the resin on the plastisol properties depends on the polymer type (homopolymer or copolymer), the molecular weight of the polymer, and the size and shape of the polymer particles. The use of a copolymer generally results in a lower fusion temperature, which may be important where the substrate is heat sensitive. For example, a 7% vinyl acetate copolymer will have a fusion temperature of approximately 135° to 140° Centigrade, a 3% vinyl acetate copolymer will have a fusion temperature of approximately 155° to 160° Centigrade, and a polyvinyl chloride homopolymer will have a fusion temperature generally around 175° Centigrade. Higher molecular weight resins generally yield coatings with higher physical strength, but require more heat and longer fusion time than lower molecular weight resins. Finally, finer particle sizes and more irregular shapes generally provide larger total surface area and therefore higher plasticizer absorption, resulting in higher viscosity and poor viscosity stability.

Extender resins are primarily used to lower the coast of the plastisol formulation. They usually have low oil absorption characteristics which reduce the viscosity of the plastisol at a given plasticizer level. They also produce a grainy surface in coatings which reduces surface gloss.

Plasticizers are used primarily to impart fluidity to resins and may be categorized structurally as monomeric or polymeric, and functionally as primary or secondary. Polymeric plasticizers are higher in viscosity which is generally a disadvantage in plastisol compounding. A primary plasticizer has good permanence, compatibility and plasticizing efficiency, whereas secondary plasticizers are less compatible and less efficient. In general, the quantity of plasticizer required to produce a specific elongation or softness is a measure of its efficiency. With few exceptions, the most efficient plasticizers are also the highest solvating and fastest fusing.

Stabilizers are used in plastisols to counteract degradation of vinyl chloride resins which occurs due to the heat required for curing of the plastisol. Stabilizers also help prevent discoloration caused by degradation.

Fillers are primarily used in plastisols for cost reduction, but they can impart certain desirable qualities, such as better electrical properties, reduced tackiness and better scuff resistance. However, an increased filler content generally increases viscosity, which may be undesirable.

Small quantities of volatile diluents are commonly used in plastisols to lower viscosity.

Some other additives that are sometimes used in formulating plastisols are thickeners, surfactants and blowing agents. Thickeners are generally used to increase low shear viscosity or make the plastisol more thixotropic, so that the plastisol does not sag after deposition on the substrate. High viscosities can generally be obtained by decreasing the plasticizer level, but if it is not desirable also to increase high shear viscosity, thickeners are used. Surfactants are generally used to lower viscosity and improve viscosity stability and air release. Finally, blowing agents are used to alter density by producing either open cell or closed cell foam structure in the cured coating.

It will be appreciated from the above, that plastisols can be formulated having a wide variety of properties. The most important properties for the purposes of the present invention are fusion time and temperature, and viscosity. Plastisols are formulated for use on coating apparatus 10 so that these properties are compatible with the substrate being coated and the speed at which the apparatus is to be operated. For example, a loose weave substrate generally requires medium viscosity at both low and high shear rates. A tight weave or continuous substrate generally requires low viscosity at both low and high shear rates. Substrates with higher strength generally can undergo higher coating speeds, and at high coating speeds, low fusion temperature and time is desirable to reduce the size of the heat drum or the temperature at which it must be operated to cure the plastisol. It will be appreciated by those skilled in the art, that if the properties of a particular plastisol formulation are not compatible with the substrate to be coated, the formulation of the plastisol may be easily changed to give compatible viscosity and fusion properties.

Having described a preferred embodiment, it will be appreciated that various modifications may be made to the apparatus and method of coating substrates as described above. For example, rather than using a gravure type coater in coating station 20, any other type of coating apparatus could be used that would coat the substrate with a layer of liquid plastic. In particular, some other types of coaters that could be used are various types of knife coaters, other types of roll coaters such as kiss coaters, squeeze coaters and reverse roll coaters, and also spray type coaters. Further, in a gravure type coater, a doctor blade could be used in conjunction with the applicator roll for printing on the substrate with the plastisol. In a printing application, however, the coating nip pressure would be sufficiently high to eliminate the formation of plastisol bank 58 just before the nip of put-on roll 32, so that the printed pattern would not be smudged. It should be noted that plastisol bank 58 could be eliminated in normal coating operations, if the cross-sectional uniformity of the cured plastic coating is not particularly important, or if the coating station can apply the liquid plastic with satisfactory uniformity in cross-section.

Embossing station 34 could be eliminated if desired or replaced by a simple calendering station depending upon the surface finish desired on the coated substrate. However, embossing improves adhesion of the plastic coating, especially where a continuous substrate is being coated.

Cooling roll 36 could also be eliminated or replaced by some other cooling means. In addition, further processing could be done to the coated substrate before being wound into finished roll 38, such as trimming, slitting or printing, etc..

It will be appreciated that the present invention provides a very simple method of coating a substrate with a liquid plastic and of curing the liquid plastic to produce a plastic coated substrate. The liquid plastic, for example a plastisol, is cured to the gel state very quickly upon the application of heat and pressure between the put-on roll and the heat drum. This reduces the tendency of fumes or smoke being discharged, which is usually a problem in oven curing systems requiring expensive pollution control devices.

What I claim is:

1. A method of producing a plastic coated substrate comprising: coating the substrate with a plastisol; providing a nip defined by a transverse put-on roll and a transverse heat drum for compressing the coated substrate; locating the substrate in said nip; smoothing and spreading the plastisol over the substrate by producing relative movement between the coated substrate and said nip; and heating the coated substrate in said nip to partially cure the plastisol.

2. A method as claimed in claim 1 wherein the coated substrate is heated in said nip to cure the plastisol to gelation, and wherein the coated substrate is heated further to complete the curing of the plastisol.

3. A method as claimed in claim 1 wherein the coated substrate is heated in said nip by passing the coated substrate around a cylindrical heat drum forming part of said nip, the drum being in contact with the plastisol.

4. A method as claimed in claim 1 wherein the coated substrate is passed through said nip, the put-on roll being pressed against the heat drum to compress said substrate.

5. A method as claimed in claim 1 wherein the plastisol is smoothed and spread by rolling the plastisol over the substrate using a heated drum as part of said nip.

6. A method as claimed in claim 2 wherein said further heating of the coated substrate is done by passing the coated substrate around a heated drum forming part of said nip, so that the coated substrate is continuously in contact with the heated drum until the curing of the plastisol is completed.

7. A method as claimed in claim 1 wherein the substrate is coated with plastisol by depositing plastisol on the substrate in a predetermined pattern to produce a plastisol printed substrate.

8. A method as claimed in claim 1 wherein said plastisol is of the type having polyvinyl chloride homopolymer as the resin component.

9. A method as claimed in claim 8 wherein the substrate is formed of paper.

10. A method of plastic coating a web comprising: coating the web with a layer of plastisol; passing the coated web through a nip defined by a transverse put-on roll and a transverse heat drum to smooth and spread the plastisol over the web; compressing and heating the web in said nip to partially cure the plastisol to gelation; and applying additional heat to the coated web until complete fusion occurs in the plastisol.

11. A method as claimed in claim 10 wherein said nip is formed by a transverse heat drum and a transverse put-on roll, the put-on roll being pressed against the heat drum.

12. A method as claimed in claim 4 wherein a plastisol bank is formed between the substrate and the heat drum.

13. A method as claimed in claim 11 wherein a plastisol bank is formed between the web and the heat drum.

14. A method as claimed in claim 10 wherein the plastisol is of the type having polyvinyl chloride homopolymer as the resin, and wherein the web is formed of paper.

* * * * *